US011117698B2

(12) United States Patent
Matsumura

(10) Patent No.: US 11,117,698 B2
(45) Date of Patent: Sep. 14, 2021

(54) BAGGING AND PACKAGING MACHINE AND BAGGING AND PACKAGING METHOD

(71) Applicant: TOYO JIDOKI CO., LTD., Tokyo (JP)

(72) Inventor: Yuuki Matsumura, Yamaguchi-ken (JP)

(73) Assignee: TOYO JIDOKI CO., LTD., Tokyo (JP)

( * ) Notice: Subject to any disclaimer, the term of this patent is extended or adjusted under 35 U.S.C. 154(b) by 257 days.

(21) Appl. No.: 16/387,956

(22) Filed: Apr. 18, 2019

(65) Prior Publication Data

US 2019/0322402 A1 Oct. 24, 2019

(30) Foreign Application Priority Data

Apr. 20, 2018 (JP) ..... JP2018-081534

(51) Int. Cl.
*B65B 43/18* (2006.01)
*B65B 43/30* (2006.01)
(Continued)

(52) U.S. Cl.
CPC ..... *B65B 57/10* (2013.01); *B65B 43/18* (2013.01); *B65B 43/30* (2013.01); *B65B 43/44* (2013.01);
(Continued)

(58) Field of Classification Search
CPC ..... B65B 57/10; B65B 43/18; B65B 43/30; B65B 43/44; B65B 51/10; B65B 51/32; B65B 63/005
(Continued)

(56) References Cited

U.S. PATENT DOCUMENTS 2,954,195 A * 9/1960 Dobbs ..... B62B 1/18 248/101
4,473,989 A * 10/1984 Tsutsumi ..... B65B 43/30 141/166
(Continued)

FOREIGN PATENT DOCUMENTS

DE 60206546 T2 6/2006
JP 2012-180106 A 9/2012
(Continued)

OTHER PUBLICATIONS

SWING—Dictionary definition by Merriam-Webster, retrieved from https://www.merriam-webster.com/dictionary/swing URL on Feb. 24, 2021 (Year: 2021).*
(Continued)

*Primary Examiner* — Valentin Neacsu
(74) *Attorney, Agent, or Firm* — Pillsbury Winthrop Shaw Pittman, LLP

(57) ABSTRACT

A bagging and packaging machine includes a transport mechanism and a plurality of processing units. The transport mechanism transports a pouch in a standing posture, along a predetermined track. The processing units process the pouch transported by the transport mechanism. The processing units include a filling unit that fills the pouch with an object to be packaged. The transport mechanism has a holding unit that holds the pouch, and a swinging mechanism that swings the pouch, which has been filled with the object to be packaged in the filling unit, in a vertical plane parallel to a transport direction.

20 Claims, 8 Drawing Sheets

(51) Int. Cl.

| | |
|---|---|
| ***B65B 43/44*** | (2006.01) |
| ***B65B 51/10*** | (2006.01) |
| ***B65B 51/32*** | (2006.01) |
| ***B65B 57/10*** | (2006.01) |
| ***B65B 63/00*** | (2006.01) |

(52) U.S. Cl.
CPC ..... *B65B 51/10* (2013.01); *B65B 51/32* (2013.01); *B65B 63/005* (2013.01)

(58) Field of Classification Search
USPC ..... 53/468, 284.7, 253; 198/468.4, 468.3
See application file for complete search history.

(56) References Cited

U.S. PATENT DOCUMENTS

| | | | | |
|---|---|---|---|---|
| 5,086,609 | A * | 2/1992 | Tetenborg | B65B 1/02 53/373.6 |
| 5,442,898 | A * | 8/1995 | Gabree | B65B 37/04 53/385.1 |
| 6,712,196 | B2 * | 3/2004 | Ikemoto | B65B 43/465 198/430 |
| 7,021,036 | B2 * | 4/2006 | Hiramoto | B65B 43/04 53/562 |
| 2002/0148206 | A1 * | 10/2002 | Ikemoto | B65B 43/465 53/570 |
| 2004/0206056 | A1 * | 10/2004 | Hiramoto | B65B 59/003 53/562 |
| 2006/0156691 | A1 * | 7/2006 | Yokota | B65B 61/28 53/167 |
| 2014/0083559 | A1 * | 3/2014 | Korte | B65B 43/465 141/10 |
| 2014/0331603 | A1 * | 11/2014 | Takahashi | B65B 31/06 53/408 |
| 2015/0217889 | A1 * | 8/2015 | Nakamoto | B65B 43/50 198/678.1 |
| 2015/0266601 | A1 * | 9/2015 | Vollenkemper | B65B 61/28 53/249 |
| 2018/0215489 | A1 * | 8/2018 | Gallaun | B65B 43/30 |
| 2019/0127100 | A1 * | 5/2019 | Matsumura | B65B 43/30 |

FOREIGN PATENT DOCUMENTS

| | | | |
|---|---|---|---|
| JP | 2012-218783 | A | 11/2012 |
| JP | 5563511 | B2 | 7/2014 |
| WO | 2014/191152 | A1 | 12/2014 |
| WO | 2018/060277 | A1 | 4/2018 |

OTHER PUBLICATIONS

Extended European Search Report EP Application No. 19170193.7 dated Jul. 22, 2019.

* cited by examiner

BAGGING AND PACKAGING MACHINE AND BAGGING AND PACKAGING METHOD

CROSS-REFERENCE TO RELATED APPLICATIONS

This application is based upon and claims the benefit of priority from Japanese Patent Application No. 2018-081534, filed on Apr. 20, 2018; the entire contents of which are incorporated herein by reference.

FIELD OF THE INVENTION

The present invention relates to a bagging and packaging machine and a bagging and packaging method.

BACKGROUND ART

A bagging and packaging machine including a transport mechanism configured to transport a pouch along a predetermined track, and a plurality of processing units that process a pouch transported by the transport mechanism has been conventionally known. The bagging and packaging machine includes, for example, an empty-pouch supply unit, a mouth opening unit, a filling unit, a sealing unit and a discharge unit, which are arranged in this order along the predetermined track. In the bagging and packaging machine, an empty pouch is supplied by the empty pouch supply unit, a pouch mouth of the pouch is opened in the mouth opening unit, the pouch is filled with an article (object to be packaged) in the filling unit, the pouch mouth of the pouch is sealed by the sealing unit, and the pouch is discharged in the discharge unit to the outside of the machine.

A pouch can be filled with various objects to be packaged. One example of these objects to be packaged is a fluid article. A fluid article is an article having a fluidity in a state where the article is filled in a pouch. For example, the fluid article is liquid, powder, and a mixture including liquid or powder.

In the bagging and packaging machine, a pouch is not always transported along the track at a uniform speed. In accordance with a process in the processing unit, a pouch is accelerated or decelerated during its transport. When an object to be packaged is a fluid article, the object to be packaged filled in the pouch may shake by the action of inertia force, upon acceleration or deceleration. The inertia force acts rearward of the traveling direction upon acceleration, and acts forward of the traveling direction upon deceleration. In particular, in a so-called intermittent transport in which the transport is temporarily stopped at each processing unit and is then restarted after a predetermined process has been performed in the processing unit, the object to be packaged shakes significantly when the transport is started or stopped.

FIG. 9 schematically shows a shaking state of an object to be packaged in a pouch. In FIG. 9, the left figure shows a pouch 300 in a static state, the center figure shows the pouch 300 when the transport is started, and the right figure shows the pouch 300 when the transport is stopped. In the illustrated example, the pouch 300 is filled with an object to be packaged 400 that is a fluid article. Upper portions of side edges of the pouch 300 are gripped by a pair of grippers 122. The pouch 300 has an area to be sealed 450 that is sealed in a sealing step performed after the object to be packaged 400 has been filled. In the static state, a surface (liquid level) of the object to be packaged 400 is parallel to the horizontal direction. Upon start of the transport, the object to be packaged 400 is moved rearward (left side in FIG. 9) of the traveling direction by the action of inertia force. On the other hand, upon stop of the transport, the object to be packaged 400 is moved forward (right side in FIG. 9) of the traveling direction by the action of inertia force. As shown, when the transport is started and stopped, the object to be packaged 400 may attach to a vicinity (area to be sealed 450) of a pouch mouth 310 inside the pouch 300. The object to be packaged 400 attached to the area to be sealed 450 is pinched in the area to be sealed 450 in the sealing step to interfere with a sealing property of the pouch mouth 310. Thus, sealing failure (jamming seal) of the pouch 300 occurs. When a moving amount of the object to be packaged 400 by the action of inertia force is large, the object to be packaged 400 may escape outside from the pouch mouth 310.

JP 2012-180106 A describes that, after a pouch has been filled with a liquid object, right and left grippers are separated from each other so that a portion of the pouch between the grippers is tensed. Thus, it is possible to prevent the liquid object from adhering to an area of the pouch that is intended to be sealed. In addition, JP 5563511 B describes that, after a pouch has been filled with a liquid object, the right and left grippers are brought close to each other so that an opening shape of the portion of the pouch between the grippers has a substantially elliptical shape that is elongated in a thickness direction of the pouch. Thus, liquid splashing accompanied with the intermittent transport can be restrained.

However, J P 2012-180106 A and JP 5563511 B cannot restrain the movement itself of the liquid object filled in the pouch by the action of inertia force, and cannot sufficiently prevent the attachment of the liquid object to the area to be sealed, and the escape of the liquid object from the pouch mouth to the outside.

In order to prevent the attachment of the liquid object to the area to be sealed and the escape of the liquid object from the pouch mouth to the outside, it is conceivable that a transport speed of the pouch is reduced. However, the reduction in transport speed of the pouch interferes with productivity improvement. Further, it is conceivable that the size of the pouch is enlarged so that a distance between the surface of the object to be packaged and the area to be sealed is elongated. However, the enlargement of the pouch size increases a transport cost of the pouch.

SUMMARY OF THE INVENTION

The present invention has been made in view of the above circumstances. The object of the present invention is to restrain occurrence of sealing failure and escape of an object to be packaged to the outside of a pouch.

A bagging and packaging machine according to the present invention comprises:

a transport mechanism that transports a pouch in a standing posture, along a predetermined track; and a plurality of processing units that process the pouch transported by the transport mechanism;

wherein:

the processing units include a filling unit that fills the pouch with an object to be packaged; and the transport mechanism has a holding unit that holds the pouch, and a swinging mechanism that swings the pouch, which has been filled with the object to be packaged in the filling unit, in a vertical plane parallel to a transport direction.

In the bagging and packaging machine according to the present invention, the pouch may be repeatedly moved and stopped along the predetermined track so as to be transported.

In the bagging and packaging machine according to the present invention, the swinging mechanism may have:

a support unit that swingably supports the holding unit;

a drive source that swings the holding unit; and a control unit that controls an operation of the drive source.

In the bagging and packaging machine according to the present invention, the swinging mechanism may further have:

a drive-source-side swinging member fixed with respect to a drive shaft of the drive source;

a holding-unit-side swinging member fixed with respect to the holding unit; and a coupling member that couples the drive-source-side swinging member and the holding-unit-side swinging member.

In the bagging and packaging machine according to the present invention, the control unit may control the operation of the drive source such that an upper end edge of the pouch and a surface of the object to be packaged in the pouch become parallel.

The bagging and packaging machine according to the present invention may further comprise a detection apparatus that detects a state of the object to be packaged in the pouch, wherein the control unit controls the operation of the drive source depending on the state of the object to be packaged detected by the detection apparatus.

In the bagging and packaging machine according to the present invention, the swinging mechanism may have:

a support unit that swingably supports the holding unit; and a restriction unit that restricts the swinging movement of the holding unit within a predetermined range.

In the bagging and packaging machine according to the present invention, the holding unit may have a pair of gripping units, and one gripping unit may grip one side edge of the pouch, and the other gripping unit may grip the other side edge of the pouch.

A bagging and packaging method according to the present invention is a bagging and packaging method having a plurality of processing steps that process a pouch that is transported in a standing posture, along a predetermined track, wherein the processing steps include a filling step that fills the pouch with an object to be packaged, wherein the bagging and packaging method has a swinging step that swings the pouch in a vertical plane parallel to a transport direction, when the pouch is transported after the filling step.

In the bagging and packaging method according to the present invention, the pouch may be repeatedly moved and stopped along the predetermined track so as to be transported.

In the bagging and packaging method according to the present invention, in the swinging step, the pouch may be swung such that an upper end edge of the pouch and a surface of the object to be packaged in the pouch become parallel.

The present invention can restrain occurrence of sealing failure and escape of an object to be packaged to the outside of a pouch.

DETAILED DESCRIPTION OF THE INVENTION

Figure 1:
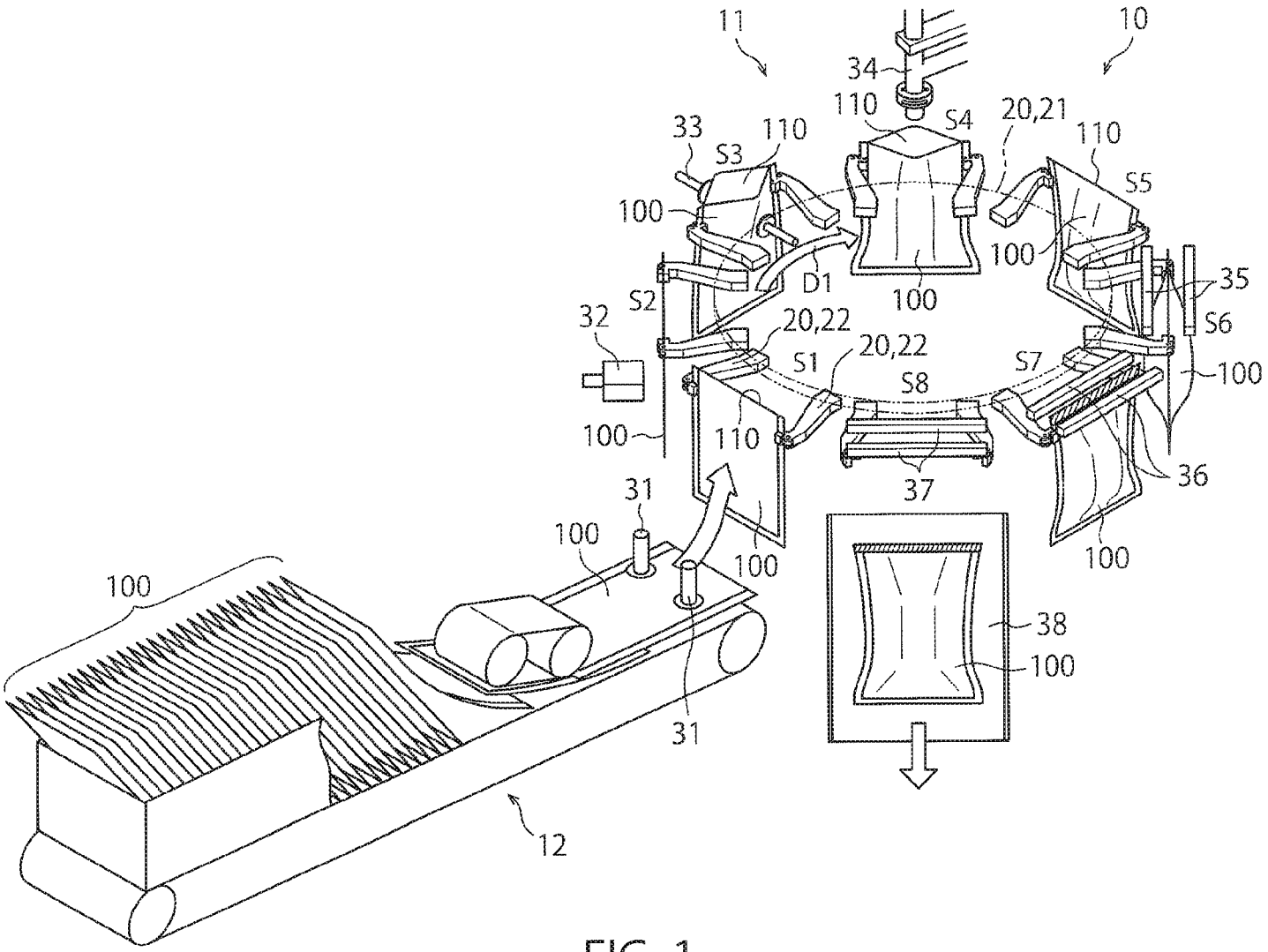
FIG. 1 is a view for describing an embodiment of the present invention, which is a perspective view of an overall structure of a bagging and packaging machine.

An embodiment of the present invention is described herebelow with reference to the drawings. FIGS. 1 to 8 are views for describing one embodiment of the present invention. FIG. 1 is a perspective view showing an overall structure of a bagging and packaging machine.

The bagging and packaging machine 10 comprises a pouch processing apparatus 11 and a conveyor magazine 12. In the conveyor magazine, a plurality of pouches 100 are stacked and stored. Each pouch 100 stored in the conveyor magazine 12 is an empty pouch. A pouch mouth 110 is closed, and sidewall parts forming the pouch mouth 100 are opposed and in contact with each other. The pouches 100 stored in the conveyor magazine 12 are held one by one, by a pouch taking-out unit 31 constituted by a suction cup or the like, and are transferred from the pouch taking-out unit 31 to respective holding units 22 of the pouch processing apparatus 11.

The pouch processing apparatus 11 comprises: a transport mechanism 20 that transports a pouch 100 in a standing posture, along a predetermined track; and a plurality of processing units (a first station S1 to an eighth station S8) that process a pouch 100 transported by the transport mechanism 20. The transport mechanism 20 comprises: a transport table 21 that is intermittently rotated about an axis, a plurality of holding units 22 each for holding a pouch 100, the holding units 22 being mounted equidistantly on an outer circumferential part of the transport table 21; and a swinging mechanism 40 (not shown in FIG. 1) described later. In FIG. 1, the transport table 21 is shown by two-dot chain lines in order to facilitate understanding of other structures. Each holding unit 22 includes a pair of right and left gripping units 23*a*, 23*b*. Side parts of each pouch 100, which are positioned opposite to each other through a pouch mouth 110, are respectively held by the gripping units 23*a*, 23*b*. The pouch 100 is held and transported by the holding unit 22, such that the pouch 100 takes a standing posture. Particularly in the illustrated example, each pouch 100 is held and transported in a suspended state by the holding unit 22. The "standing posture" herein means a posture of the pouch 100 in which the sidewall parts forming the pouch 100 extend substantially along the vertical direction. Each holding unit 22 is intermittently moved along a transport direction (rotation direction) D1 together with the transport table 21, and is intermittently stopped at the first station S1 to the eighth station S8. Namely, the pouch 100 is repeatedly moved and stopped along the predetermined track so as to be transported. The number of holding units 22 corresponds to the number of stations S1 to S8. Thus, the bagging and packaging machine 10 of FIG. 1 is equipped with the eight holding units 22.

In the first station (empty-pouch supply unit) S1, a pouch 100 is delivered by the pouch taking-out unit 31 from the conveyor magazine 12 to the holding unit 22 (empty-bag supplying step). In the second station (printing unit) S2, a production date, an expiration date and so on are printed on a surface of the pouch 100 by a printing apparatus 32 (printing step). In the third station (mouth opening unit) S3, the pouch mouth 110 of the pouch 100 is opened by a mouth opening apparatus 33 (mouth opening step). In the fourth station (filling unit) S4, a discharge outlet of a filling apparatus 34 is located inside the pouch 100 through the pouch mouth 110, and an object to be packaged 200 is filled into the pouch 100 from the filling apparatus 34 (filling step). In the fifth station (mouth closing unit) S5, a distance between the pair of gripping units 23*a*, 23*b* of the holding unit 22 is expanded to close the pouch mouth 110 (mouth closing step). The mouth closing step may be performed after the object to be packaged 200 has been put into the pouch 100 in the fourth station S4, or during the movement from the fourth station S4 to the fifth station S5, or during the movement from the fifth station S5 to the sixth station S6. In the sixth station (first pouch-mouth sealing unit) S6, the pouch mouth 110 of the pouch 100 is heat-sealed by a first sealing apparatus 35 (first pouch-mouth sealing step). In the seventh station (second pouch-mouth sealing unit) S7, the pouch mouth 110 of the pouch 100 is heat-sealed by a second sealing apparatus 36 (second pouch-mouth sealing step). In the eighth station (cooling unit) S8, the heat-sealed pouch mouth 110 of the pouch 100 is cooled by a cooling apparatus 37 (sealed-portion cooling step), and the pouch 100 is released from the gripping by the gripping units 23*a*, 23*b* of the holding unit 22 to fall down to a discharge chute 38. The pouch 100 having fallen down to the discharge chute 38 is guided by the discharge chute 38 so as to be sent to a succeeding stage.

Figure 2:
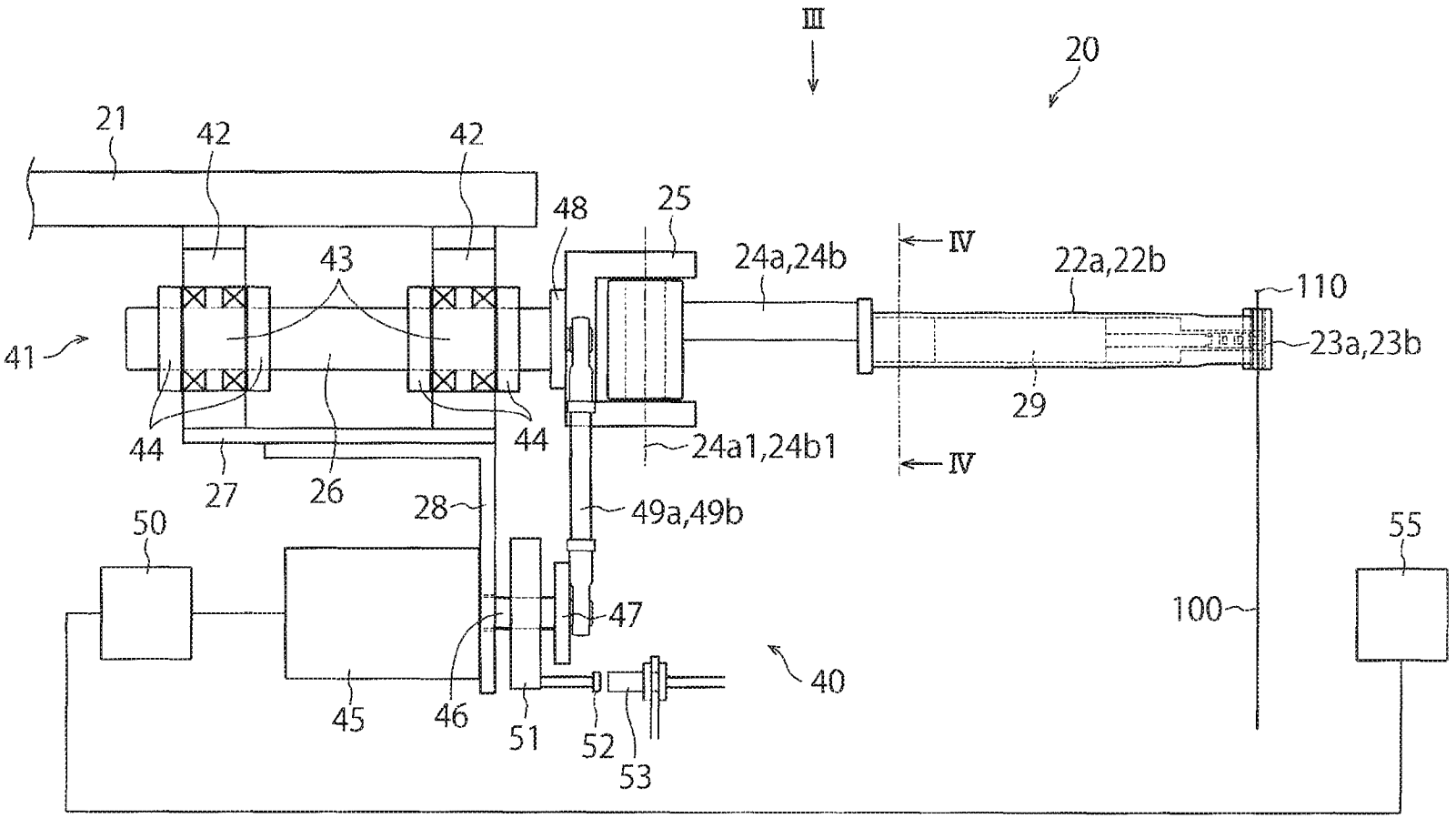
FIG. 2 is a side view showing a holding unit of a transport mechanism of a swinging mechanism of the bagging and packaging machine.
Figure 3:
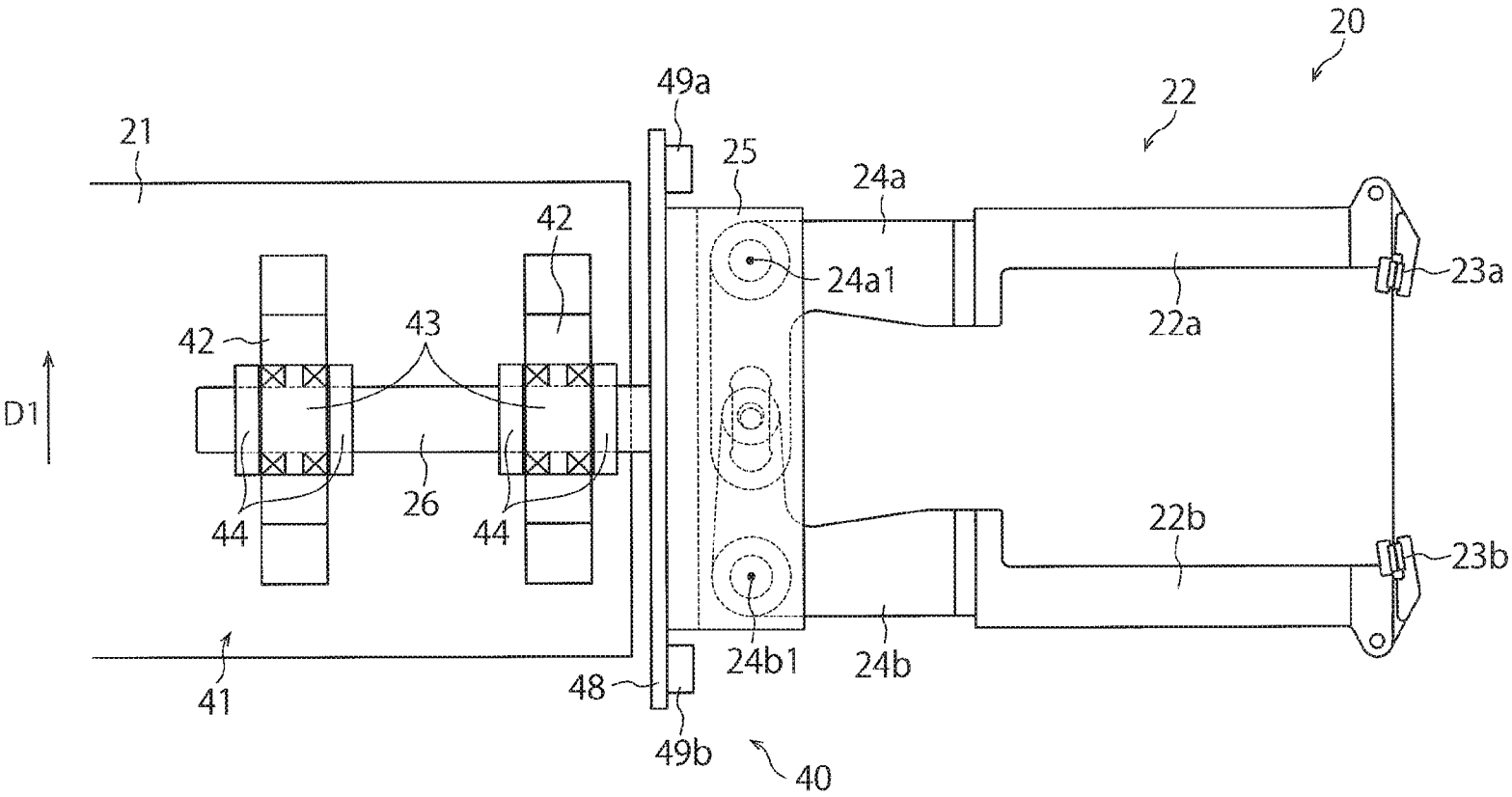
FIG. 3 is a plan view showing the holding unit and the swinging mechanism of FIG. 2.
Figure 4:
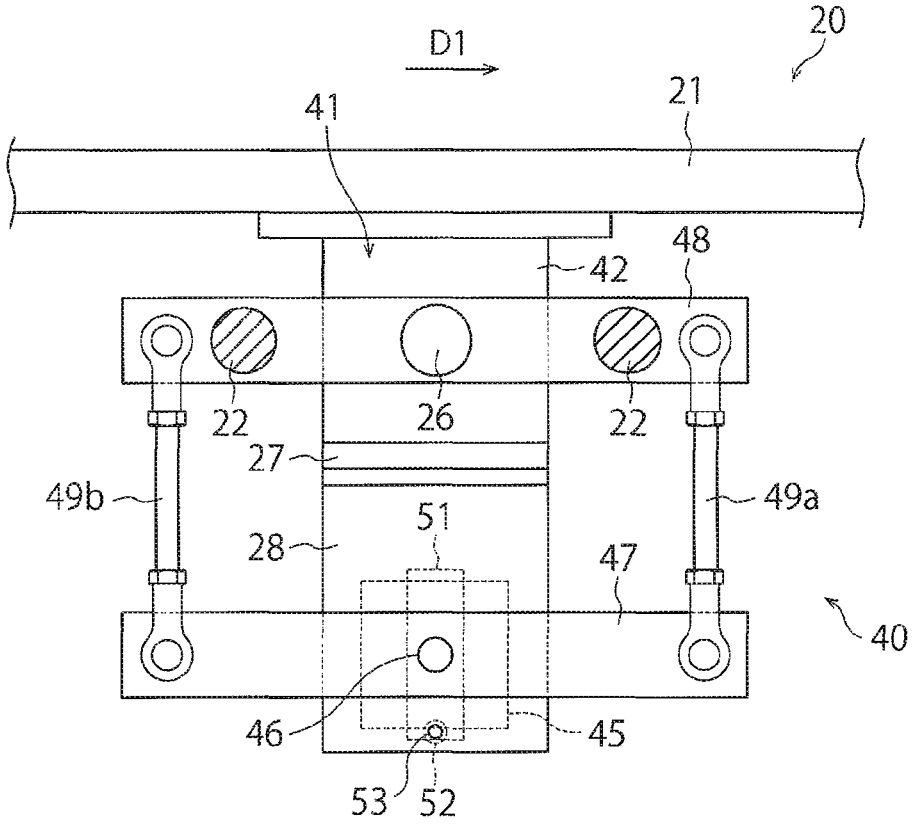
FIG. 4 is a front view showing the swinging mechanism of FIG. 2.

Next, the transport mechanism 20 is described in detail with reference to FIGS. 2 to 4. FIG. 2 is a side view showing the holding unit 22 and the swinging mechanism 40 of the transport mechanism 20. FIG. 3 is a top view of the holding unit 22 and the swinging mechanism 40, in particular, a view showing the holding unit 22 and the swinging mechanism 40 that are seen along an arrow III in FIG. 2. FIG. 4 is a front view showing the swinging mechanism 40. In FIG. 4, a location of the holding unit 22 is shown by a hatched circle.

The transport mechanism 20 has the holding unit 22 that holds a pouch 100, and the swinging mechanism 40 that swings the holding unit 22.

The holding unit 22 includes a pair of grippers 22*a*, 22*b*, gripper support plates 24*a*, 24*b* that support the grippers 22*a*, 22*b*, a gripper support block 25 that supports the gripper support plates 24*a*, 24*b*, and a rotation shaft 26. The gripper 22*a*, 22*b* has, at its distal end, the gripping unit 23*a*, 23*b*. Thus, the holding unit 22 has the pair of gripping units 23*a*, 23*b*. The one gripping unit 23*a* grips one side edge 112*a* of a pouch 100, and the other gripping unit 23*b* grips the other side edge 112*b* of the pouch 100. The pouch 100 is gripped by the gripping units 23*a*, 23*b* such that the pouch 100 is suspended with the pouch mouth 110 facing upward. The gripping unit 23*a*, 23*b* is driven by an air cylinder 29 disposed in the gripper 22*a*, 22*b*.

The grippers 22*a*, 22*b* are respectively fixed, at their ends opposite to the gripping units 23*a*, 23*b*, on the gripper support plates 24*a*, 24*b*. The gripper support plates 24*a*, 24*b* are mounted movably with respect to the gripper support block 25. The gripper support plates 24*a*, 24*b* are horizontally opened or closed about rotation axis lines 24*a*1, 24*b*1, respectively, whereby the pair of grippers 22*a*, 22*b* are separated from each other or brought close to each other. Thus, a distance between the gripping units 23*a*, 23*b* can be varied, in accordance with a width of a pouch 100.

The gripper support block 25 is fixed with respect to a holding-unit-side swinging member 48. The rotation shaft 26 is fixed on the holding-unit-side swinging member 48. Namely, the rotation shaft 26 is fixed on the gripper support block 25 through the holding-unit-side swinging member 48. However, not limited thereto, the rotation shaft 26 may be directly fixed on the gripper support block 25. The rotation shaft 26 is a member having a columnar or cylindrical shape as a whole. A cross section of the rotation shaft 26, which is orthogonal to the longitudinal direction has a circular shape. The rotation shaft 26 is connected, at its one end, to the holding-unit-side swinging member 48. The rotation shaft 26 is supported by a support unit 41 described later.

Next, the swinging mechanism 40 is described. The swinging member 40 swings the holding unit 22 such that a pouch 100, which has been filled with the object to be packaged 200 in the filling unit S4, swings in a vertical plane parallel to the transport direction D1. The "vertical plane parallel to the transport direction D1" means a vertical plane including a direction of action of the inertia force which may act on the object to be packaged 200 in the pouch 100, when the pouch 100 is accelerated or decelerated by the transport mechanism 20. Thus, when the transport direction D1 is not rectilinear as in the example shown in FIG. 1, the "vertical plane parallel to the transport direction D1" means, at a location where the pouch is positioned, a vertical plane parallel to a direction tangent to the transport direction D1. The "vertical plane" herein is not limited to the vertical plane in a strict sense, but includes a plane that is inclined to the vertical plane in a strict sense, as long as the object to be packaged 200 does not attach to the area to be sealed of the pouch 100 and does not escape outside from the pouch mouth 110.

In the example shown in FIGS. 2 to 4, the swinging mechanism 40 includes the support unit 41 that swingably supports the holding unit 22, a drive source 45 that swings the holding unit 22, and a control unit 50 that controls an operation of the drive source 45. In the illustrated example, the swinging mechanism 40 further has a drive-unit-side swinging member 47 fixed with respect to a drive shaft 46 of the drive source 45, the holding-unit-side swinging member 48 fixed with respect to the holding unit 22, and coupling members 49*a*, 49*b* that couple the drive-source-side swinging member 47 and the holding-unit-side swinging member 48.

The support unit 41 has a rotation-shaft support block 42 and a bearing 43. The rotation-shaft support block 42 is fixed, at its upper end, on the transport table 21. In the illustrated example, two rotation-shaft support blocks 42 are disposed so as to be spaced apart from each other in the longitudinal direction of the rotation shaft 26. However, not limited thereto, one or three or more rotation-shaft support block(s) 42 may be disposed along the longitudinal direction of the rotation shaft 26. Each rotation-shaft support block 42 is provided with the bearing 43. The bearing 43 rotatably supports the rotation shaft 26 about its rotation axis line. A stopper 44 is fixed on the rotation shaft 26. Namely, the stopper 44 is rotated together with the rotation shaft 26 with respect to the support unit 41. Two stoppers 44 are provided for each bearing 43, on one side and the other side of the longitudinal direction of the rotation shaft 26. Thus, the movement of the rotation shaft 26 with respect to the support unit 41, in particular, the movement along the longitudinal direction, is prevented. A plate 27 is fixed on a lower end of the rotation-shaft support block 42. A motor mounting block 28 is fixed on the plate 27. The drive source 45 is mounted on the motor mounting block 28.

The drive source 45 is a servomotor, for example, and functions as a drive source for driving the swinging mechanism 40 so as to swing the holding unit 22. The drive source 45 has the drive shaft 46 that outputs a drive force. When the drive shaft 46 is driven in rotation about its axis line, a drive force is outputted from the drive source 45. In the illustrated example, the rotation axis line of the rotation shaft 26 and the rotation axis line of the drive shaft 46 are parallel to each other. In addition, both the rotation axis line of the rotation shaft 26 and the rotation axis line of the drive shaft 46 extend parallel to the horizontal direction. An operation of the drive source 45 is controlled by the control unit 50.

The drive-source-side swinging member 47 is fixed with respect to the drive shaft 46. Thus, the drive-source-side swinging member 47 receives a drive force from the drive source 45 so as to be rotated together with the drive shaft 46. When seen from the direction along the rotation axis line of the drive shaft 46 (see FIG. 4), the drive-source-side swinging member 47 has a rectangular shape whose longitudinal direction is orthogonal to the rotation axis line of the drive shaft 46. In addition, when seen from the direction along the rotation axis line of the rotation shaft 26 (see FIG. 4), the holding-unit-side swinging member 48 has a rectangular shape whose longitudinal direction is orthogonal to the rotation axis line of the rotation shaft 26. In particular, the longitudinal direction of the drive-source-side swinging member 47 and the longitudinal direction of the holding-unit-side swinging member 48 are parallel to each other.

As well shown in FIG. 4, the coupling member 49*a* is disposed to connect one longitudinal end of the drive-source-side swinging member 47 and one longitudinal end of the holding-unit-side swinging member 48. In addition, the coupling member 49*b* is disposed to connect the other longitudinal end of the drive-source-side swinging member 47 and the other longitudinal end of the holding-unit-side swinging member 48. The coupling member 49*a*, 49*b* is coupled, at its one end, to the drive-source-side swinging member 47 by pin joint, and is coupled, at the other end, to the holding-unit-side swinging member 48 by pin joint. In the illustrated example, a distance between a point where the drive-source-side swinging member 47 is coupled to the coupling member 49*a* and a point where the drive-source-side swinging member 47 is coupled to the coupling member 49*b*, and a distance between a point the holding-unit-side swinging member 48 is coupled to the coupling member 49*a* and a point where the holding-unit-side swinging member 48 is coupled to the coupling member 49*b* are equal to each other. In addition, a distance between a point where the coupling member 49*a* is coupled to the drive-source-side swinging member 47 and a point where the coupling member 49*a* is coupled to the holding-unit-side swinging member 48, and a distance between a point where the coupling member 49*b* is coupled to the drive-source-side swinging member 47 and a point where the coupling member 49*b* is coupled to the holding-unit-side swinging member 48 are equal to each other. Thus, a parallel linkage is formed by the swinging members 47, 48 and the coupling members 49*a*, 49*b*.

A detection piece 51 is fixed on the drive shaft 46 of the drive source 45. A detection unit 52 is disposed on a lower end of the detection piece 51. In the illustrated example, when seen from the direction along the rotation axis line of the drive shaft 46 (see FIG. 4), the detection piece 51 has a rectangular shape whose longitudinal direction is orthogonal to the rotation axis line of the drive shaft 46. Particularly in the illustrated example, when seen from the direction along the rotation axis line of the drive shaft 46, the longitudinal direction of the detection piece 51 is orthogonal to the longitudinal direction of the drive-source-side swinging member 47. The detection unit 52 is formed to project from the detection piece 51 along the direction parallel to the rotation axis line 46 oppositely to the drive source 45. A sensor 53 is provided on a position facing the detection unit 53 along the direction parallel to the rotation axis of the rotation shaft 46 under a state where the holding unit 22 is not swung, i.e., under a state where the pair of grippers 22*a*, 22*b* are located at the same level with each other (see FIG. 4). The sensor 53 detects whether the detection unit 52 is located at a position close to the sensor 53 or not. Namely, when the sensor 53 detects that the detection unit 52 is located at a position close to the sensor 53, it can be estimated that the holding unit 22 is not swung. On the other hand, when the sensor does not detect that the detection unit 52 is located at a position close to the sensor 53, it can be estimated that the holding unit 22 is swung, in other words, the pair of grippers 22*a*, 22*b* are located at different levels from each other so that the pouch 100 is inclined. The specific structures of the detection piece 51, the detection unit 52 and the sensor 53 are not limited to the illustrated example.

The means for transmitting a drive force from the drive source 45 to the holding unit 22 is not limited to the aforementioned parallel linkage formed by the swinging members 47, 48 and the coupling members 49*a*, 49*b*, and various other means are available. For example, the drive shaft 46 of the drive source 45 may be directly connected to the rotation shaft 26 of the holding unit 22 so that the drive source 45 directly swings the holding unit 22.

Next, an operation of the swinging mechanism 40 is described with reference to FIGS. 4 to 7. FIG. 7 is a view showing a state of the object to be packaged 200 in the pouch 100 that is swung.

In the fourth station (filling unit) S4, the pouch 100 is filled with the object to be packaged 200 from the filling apparatus 34, while the holding unit 22 is being stopped (static) (filling step). In the illustrated example, the object to be packaged 200 is a fluid article. The fluid article is an article having fluidity when filled in the pouch 100, and is, for example, liquid, powder, and mixture including liquid or powder. As shown in the left figure in FIG. 7, when the filling of the object to be packaged 200 is completed in the fourth station S4, a surface (liquid level) 210 of the object to be packaged 200 filled in the pouch 100 is parallel to the horizontal direction. In this case, the holding unit 22 is not swung, and the pair of grippers 22*a*, 22*b* are located at the same level with each other, as shown in FIG. 4. At this time, the sensor 53 detects that the detection unit 52 is located at a position close to the sensor 53, whereby it can be estimated that the holding unit 22 is not swung.

After the completion of the filling step, the pouch 100 filled with the object to be packaged 200 is transported between the stations (between steps). When the transport is started, the object to be packaged 200 in the pouch 100 is moved rearward along the transport direction D1 by the action of inertia force, so that the surface 210 of the object to be packaged 200 is inclined with respect to the horizontal direction. In this embodiment, at this timing, the control unit 50 controls the drive source 45 to swing the holding unit 22 (swinging step) such that a lower end edge 113 of the pouch 100 is displaced rearward along the transport direction D1 with respect to an upper end edge 111. Thus, as shown in the center figure of FIG. 7, the pouch 100 is inclined with respect to the transport direction D1.

Figure 5:
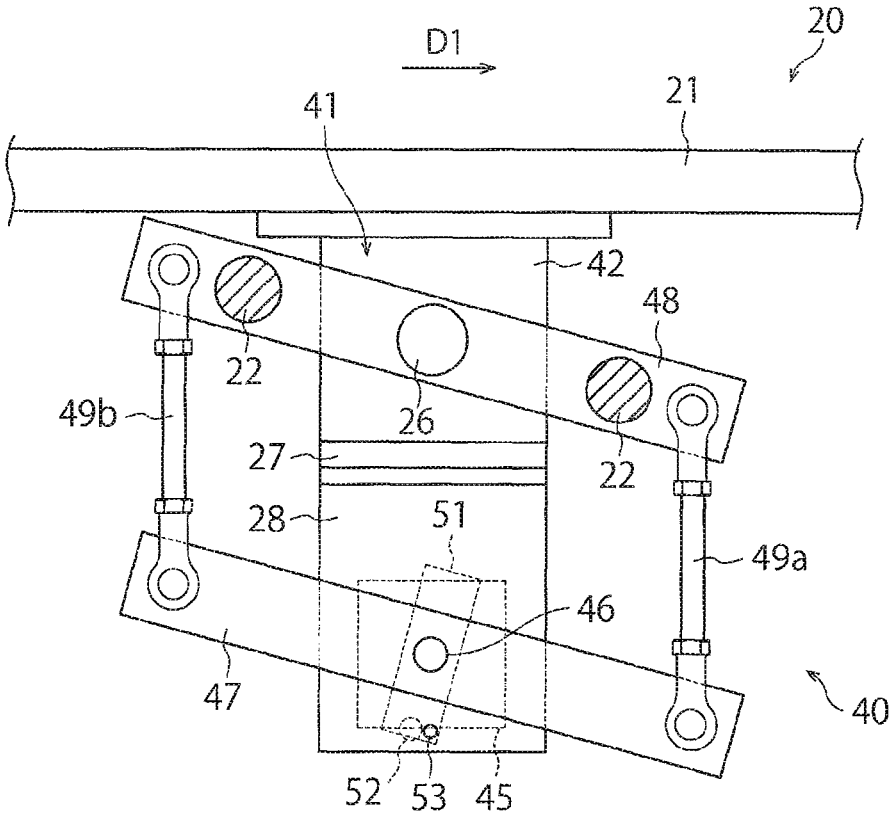
FIG. 5 is a view for describing an operation of the swinging mechanism.

As shown in FIG. 5, the drive source 45 is driven by the control of the control unit 50 so that the drive shaft 46 is rotated clockwise in FIG. 5. With the rotation of the drive shaft 46, the drive-source-side swinging member 47 fixed on the drive shaft 46 is rotated about the rotation axis line of the drive shaft 46 so that its longitudinal direction is inclined with respect to the horizontal direction. Thus, the holding-unit-side swinging member 48 connected to the drive-source-side swinging member 47 through the coupling members 49*a*, 49*b* is also rotated so that its longitudinal direction is inclined with respect to the horizontal direction. As a result, the holding unit 22 fixed with respect to the holding-unit-side swinging member 48 is swung. In detail, a forward end (right end in FIG. 5) of the swinging member 47, 48 in the transport direction D1 is moved downward, while a rearward end (left end in FIG. 5) thereof in the transport direction D1 is moved upward. In accordance therewith, the gripper 22*a* positioned forward of the transport direction D1 is moved downward, and the gripper 22*b* positioned rearward of the transport direction D1 is moved upward. Thus, the pouch 100 is swung in a vertical plane parallel to the transport direction D1, such that its lower end edge 113 is displaced rearward along the transport direction D1 with respect to the upper end edge 111.

When the transport is stopped, the object to be packaged 200 in the pouch 100 is moved forward along the transport direction D1 by the action of inertia force, so that the surface 210 of the object to be packaged 200 is inclined with respect to the horizontal direction. In this embodiment, at this timing, the control unit 50 controls the drive source 45 to swing the holding unit 22 (swinging step) such that the lower end edge of the pouch 100 is displaced forward along the transport direction D1 with respect to the upper end edge. Thus, as shown in the right figure of FIG. 7, the pouch 100 is inclined with respect to the transport direction D1.

Figure 6:
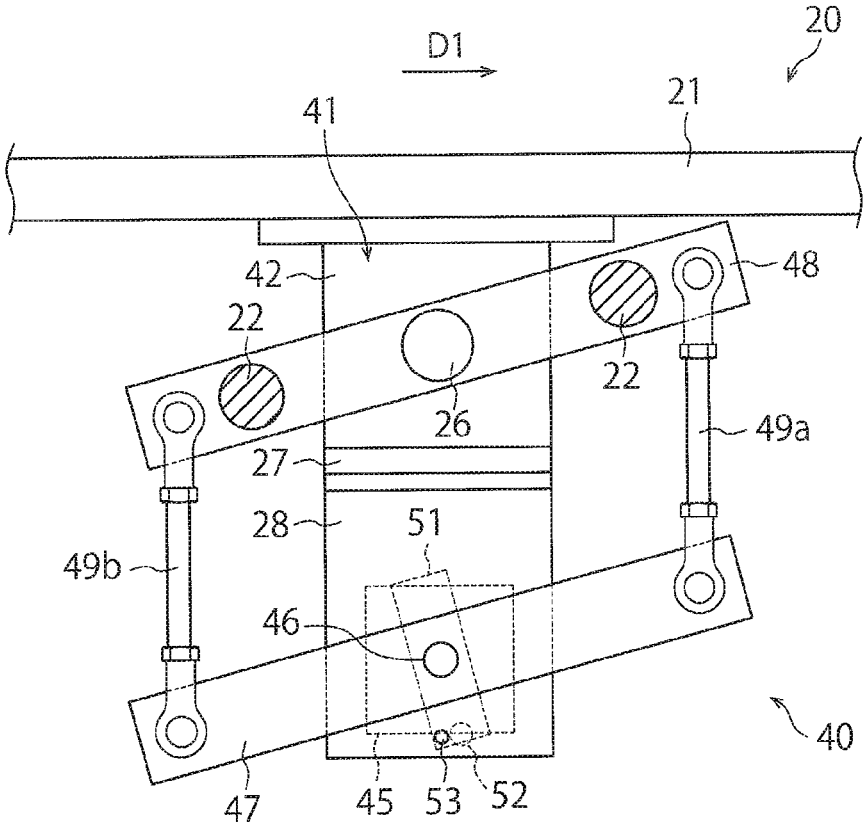
FIG. 6 is a view for describing the operation of the swinging mechanism.
Figure 7:
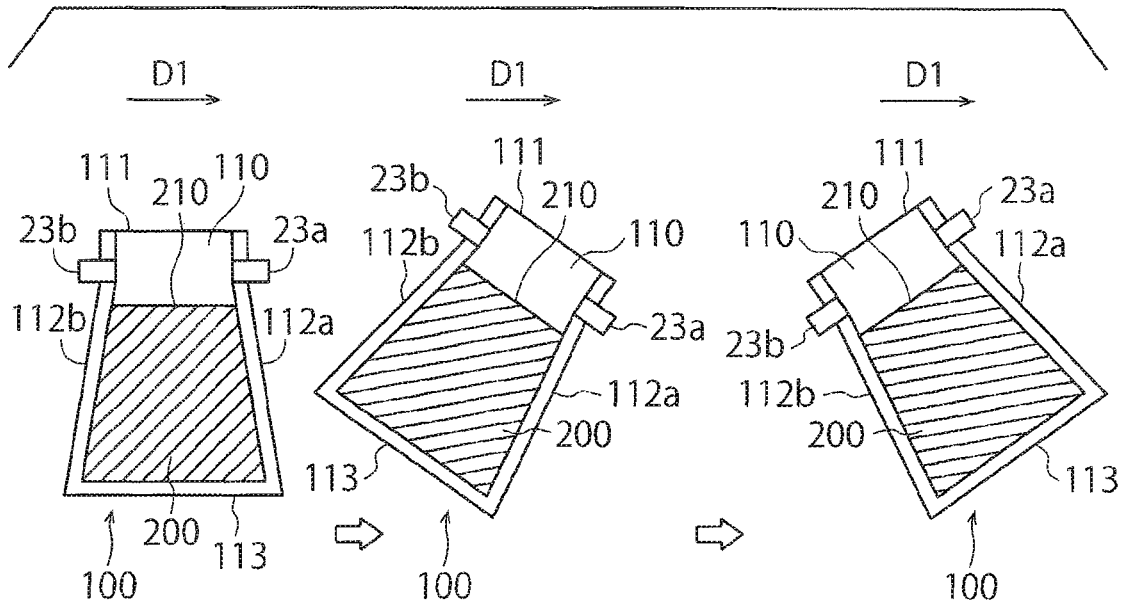
FIG. 7 is a view showing a state of an object to be packaged in a pouch that is swung.

As shown in FIG. 6, the drive source 45 is driven by the control of the control unit 50 so that the drive shaft 46 is rotated counterclockwise in FIG. 6. With the rotation of the drive shaft 46, the drive-source-side swinging member 47 fixed on the drive shaft 46 is rotated about the rotation axis line of the drive shaft 46 so that its longitudinal direction is inclined with respect to the horizontal direction. Thus, the holding-unit-side swinging member 48 connected to the drive-source-side swinging member 47 through the coupling members 49*a*, 49*b* is also rotated so that its longitudinal direction is inclined with respect to the horizontal direction. As a result, the holding unit 22 fixed with respect to the holding-unit-side swinging member 48 is swung. In detail, the forward end (right end in FIG. 6) of the swinging member 47, 48 in the transport direction D1 is moved upward, while the rearward end (left end in FIG. 6) thereof in the transport direction D1 is moved downward. In accordance therewith, the gripper 22*a* positioned forward of the transport direction D1 is moved upward, and the gripper 22*b* positioned rearward of the transport direction D1 is moved downward. Thus, the pouch 100 is swung in a vertical plane parallel to the transport direction D1, such that its lower end edge 113 is displaced forward along the transport direction D1 with respect to the upper end edge 111.

With the rotation of the drive shaft 46, the detection piece 51 and the detection unit 52 fixed on the drive shaft 46 are also rotated about the rotation axis line of the drive shaft 46. Thus, the detection unit 52 is separated from the sensor 53 when seen from the direction along the rotation axis line of the drive shaft 46. Thus, the sensor 53 detects that the detection unit 52 is located at a position spaced apart from the sensor 53, whereby it can be estimated that the holding unit 22 is swung.

The bagging and packaging machine 10 may further comprise a detection apparatus 55 that detects a state of the object to be packaged 200 in the pouch 100, and the control unit 50 may control the operation of the drive source 45 depending on the state of the object to be packaged 200 detected by the detection apparatus 55. An acceleration sensor or camera may be used as the detection apparatus 55. When an acceleration sensor is used as the detection apparatus 55, the following control is possible. Namely, the acceleration sensor detects an acceleration in the pouch 100, and the operation of the drive source 45 is controlled as a function of the acceleration such that the holding unit 22 is swung at a desired angle. On the other hand, when a camera is used as the detection apparatus 55, the following control is possible. Namely, the object to be packaged 200 in the pouch 100 is photographed by the camera to detect an inclination of the surface 210 of the object to be packaged 200, and the operation of the drive source 45 is controlled as a function of the inclination of the surface 210 such that the holding unit 22 is swung at a desired angle. In particular, the control unit 50 may control the operation of the drive source 45 such that the upper end edge 111 of the pouch 100 and the surface 210 of the object to be packaged 200 in the pouch 100 become parallel. In addition, the control unit 50 may control the operation of the drive unit 45 on a real-time basis depending on the state of the object to be packaged 200 which varies with time. Further, not limited to the control of the operation of the drive source 45 depending on the state of the object to be packaged 200 which is detected by the detection apparatus 55, the control unit 50 may control the operation of the drive source 45 such that the holding unit 22 performs a predetermined swinging movement based on a movement of the object to be packaged 200 in the pouch 100, which is understood in advance by an experiment or the like.

The bagging and packaging machine 10 of the present invention comprises: the transport mechanism 20 that transports a pouch 100 in a standing posture, along a predetermined track; and a plurality of processing units S1 to S8 that processes the pouch 100 transported by the transport mechanism 20, wherein the processing units S1 to S8 include the filling unit S4 that fills the pouch 100 with the object to be packaged 200, and the transport mechanism 20 has the holding unit 22 holding the pouch 100, and the swinging mechanism 40 that swings the holding unit 22 such that the pouch 100, which has been filled with the object to be packaged 200 in the filling unit S4, is swung in a vertical plane parallel to the transport direction D1.

In addition, a bagging and packaging method of the present invention is a bagging and packaging method including a plurality of processing steps that process a pouch 100 in a standing posture transported along a predetermined track, the processing steps include a filling step that fills the pouch 100 with the object to be packaged 200, wherein the bagging and packaging method has a swinging step that swings the pouch 100 in a vertical plane parallel to the transport direction D1, when the pouch 100 is transported after the filling step.

According to the bagging and packaging machine 10 and the bagging and packaging method, it can be effectively prevented that, when the pouch 100 is transported along the transport direction D1, the object to be packaged 200 filled in the pouch 100 shakes by the action of inertia force upon acceleration or deceleration, so that the object to be packaged 200 attaches to the area to be sealed of the pouch 100 and/or escapes from the pouch mouth 110 to the outside. In addition, it is possible to use the grippers 22*a*, 22*b* which are the same as grippers used in a conventional bagging and packaging machine. Thus, the processing units succeeding the filling unit S4 can have the same structures as those of processing units of the conventional bagging and packaging machine. In this case, since it is not necessary to manufacture a new processing unit for the bagging and packaging machine 10 of the present invention, increase in manufacturing cost of the bagging and packaging machine 10 can be avoided, while maintaining the processing ability of the bagging and packaging machine 10.

In the bagging and packaging machine 10 and the bagging and packaging method of the present invention, the pouch 100 is repeatedly moved and stopped along the predetermined track so as to be transported.

In the case where the pouch 100 is repeated moved and stopped along the predetermined track so as to be transported, when the transport is started and the transport is stopped, large inertia force acts on the object to be packaged 200 filled in the pouch 100 so that the object to be packaged 200 is likely to attach to the area to be sealed of the bagging and packaging machine 10 and/or is likely to escape from the pouch mouth 110 to the outside. Thus, in the bagging and packaging machine 10 and the bagging and packaging method, the swinging mechanism 40 can better achieve its effect.

In the bagging and packaging machine 10 of the present invention, the swinging mechanism 40 has the support unit 41 that swingably supports the holding unit 22, the drive source 45 that swings the holding unit 22, and the control unit 50 that controls the operation of the drive source 45.

According to such a bagging and packaging machine 10, an inclination angle and/or a swinging timing of the holding unit 22 can be optionally set by the control unit 50 that controls the drive source 45. Thus, a degree of freedom of the swinging movement of the holding unit 22 can be improved.

In the bagging and packaging machine 10 of the present invention, the swinging mechanism 40 further has the drive-source-side swinging member 47 fixed with respect to the drive shaft 46 of the drive source 45, the holding-unit-side swinging member 48 fixed with respect to the holding unit 22, and the coupling members 49*a*, 49*b* that couple the drive-source-side swinging member 47 and the holding-unit-side swinging member 48.

According to such a bagging and packaging machine 10, a parallel linkage can be formed by the swinging members 47, 48 and the coupling members 49*a*, 49*b*. Thus, the swinging movement caused by the swinging mechanism 40 can be more stably performed.

In the bagging and packaging machine 10 of the present invention, the control unit 50 controls the operation of the drive source 45 such that the upper end edge 111 of the pouch 100 and the surface 210 of the object to be packaged 200 in the pouch 100 become parallel.

In addition, the bagging and packaging method of the present invention swings, in the swinging step, the pouch 100 such that that the upper end edge 111 of the pouch 100 and the surface 210 of the object to be packaged 200 in the pouch 100 become parallel.

According to the bagging and packaging machine 10 and the bagging and packaging method, a shaking amount of the object to be packaged 200 with respect to the pouch 100 can be minimized, whereby it is more effectively prevent that the object to be packaged 200 attaches to the area to be sealed of the pouch 100 and/or escapes from the pouch mouth 110 to the outside.

The bagging and packaging machine 10 of the present invention further comprises the detection apparatus 55 that detects a state of the object to be packaged 200 in the pouch 100, and the control unit 50 controls the operation of the drive source 45 depending on the state of the object to be packaged 200 detected by the detection apparatus 55.

According to such a bagging and packaging machine 10, since the state of the object to be packaged 200 can be detected by the detection apparatus 55, the bagging and packaging machine 10 can cope with a situation in which a product state of the object to be packaged differs when the bagging and packaging machine 10 starts to run.

In the bagging and packaging machine 10 of the present invention, the holding unit 22 has a pair of gripping units 23*a*, 23*b*, the one gripping unit 23*a* grips one side edge 112*a* of the pouch 100, and the other gripping unit 23*b* grips the other side edge 112*b* of the pouch 100.

According to such a bagging and packaging machine 10, it is possible to use the grippers 22*a*, 22*b* which are the same as grippers used in a conventional bagging and packaging machine. Thus, the processing units succeeding the filling unit S4 can have the same structures as those of processing units of the conventional bagging and packaging machine. Therefore, since it is not necessary to manufacture a new processing unit for the bagging and packaging machine 10 of the present invention, increase in manufacturing cost of the bagging and packaging machine 10 can be avoided, while maintaining the processing ability of the bagging and packaging machine 10.

The aforementioned embodiment can be variously modified. A modification example is described herebelow with reference to the drawings. In the below description and the drawings used in the below description, a component that has the similar structure to that of the above embodiment has the same reference numeral as the reference numeral used to the corresponding component in the above embodiment, and overlapped description is omitted.

Figure 8:
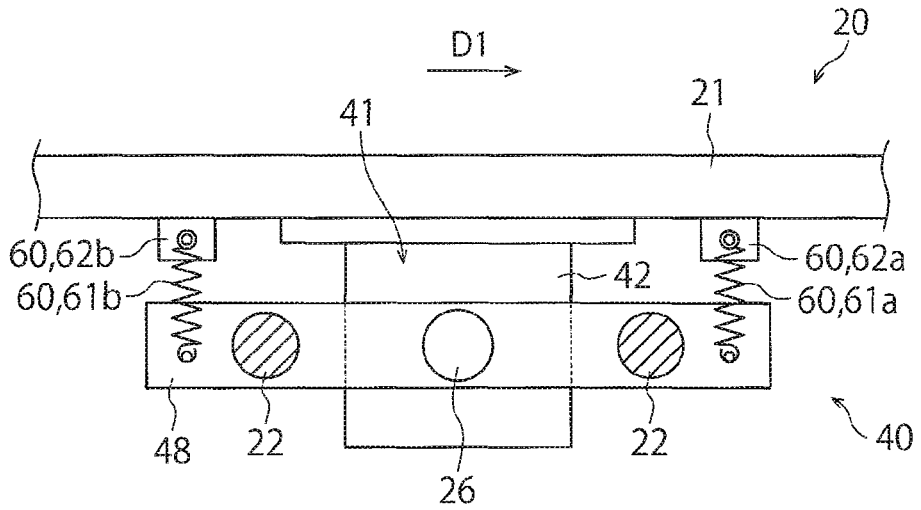
FIG. 8 is a view showing a modification example of the swinging mechanism.
Figure 9:
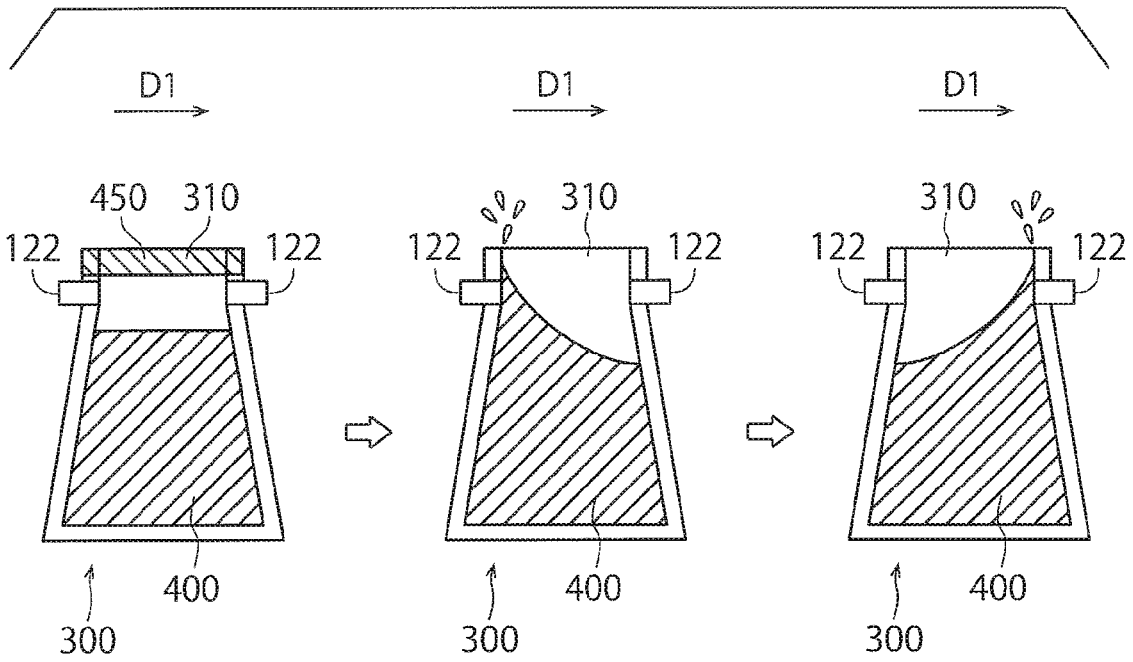
FIG. 9 is a view showing a state of an object to be packaged in a pouch according to the prior art.

FIG. 8 is a view corresponding to FIG. 4, showing a modification example of the swinging mechanism 40. In the example shown in FIG. 8, the swinging mechanism 40 has the support unit 41 that swingably supports the holding unit 22, and a restriction unit 60 that restricts the swinging movement of the holding unit 22 within a predetermined range.

The restriction unit 60 has resilient members 61*a*, 61*b*, and resilient-member support units 62*a*, 62*b* supporting the resilient members 61*a*, 61*b*. The resilient-member support units 62*a*, 62*b* are fixed on the transport table 21. The resilient member 61*a*, 61*b* is, for example, a coil spring, and spans between the holding-unit-side swinging member 48 and the resilient-member support unit 62*a*, 62*b*. The rotation shaft 26 is rotatably supported on the support unit 41. Namely, the rotation of the rotation shaft 26 about its rotation axis line is not restricted.

Upon start of the transport of the pouch 100, when the object to be packaged 200 in the pouch 100 is moved rearward along the transport direction D1 by the action of inertia force, the pouch 100 is swung in a vertical plane parallel to the transport direction D1 such that the lower end edge 113 is displaced rearward along the transport direction D1 with respect to the upper end edge 111. At this timing, the gripper 22*a* positioned forward of the transport direction D1 is moved downward, while the gripper 22*b* positioned rearward of the transport direction D1 is moved upward. In accordance therewith, the forward end (right end in FIG. 8) of the holding-unit-side swinging member 48 in the transport direction D1 is moved downward, while the rearward end (left end FIG. 8) thereof in the transport direction D1 is moved upward. Then, the resilient member 61*a* positioned forward of the transport direction D1 is pulled, and the holding-unit-side swinging member 48 stops at a position where a moment that rotates the holding-unit-side swinging member 48 and a resilient force of the resilient member 61*a* to return balance out. When the transport of the pouch 100 is stopped, an operation reverse to the operation when the transport of the pouch 100 is started occurs, and detailed description thereof is omitted.

According to this modification example, since the drive source 45 and the parallel linkage can be omitted, reduction in size and cost of the swinging mechanism 40 can be achieved. In addition, the holding unit 22 can be swung in synch with the movement of the object to be packaged 200 in the pouch 100.

As another modification example, a spouted pouch can be used as the pouch 100. In this case, the holding unit 22 can be formed to have a holding claw for holding the spout.

As yet another modification example, in the filling step in the fourth station (filling unit) S4, the pouch 100 may be inclined with respect to its standing posture, and the object to be packaged 200 may be filled into the pouch 100. For example, in the filling step, the pouch 100 may be inclined such that the lower end edge 113 is displaced forward or rearward along the transport direction D1 with respect to the upper end edge 111, in a vertical plane parallel to the transport direction D1. Such an inclination of the pouch 100 can be realized with the use of the swinging mechanism 40, similarly to the above swinging step.

When the object to be packaged 200 is an article that easily lathers such as detergent, in the filling step, there is a possibility that the object to be packaged 200 lathers by the impact caused when the object to be packaged 200 falls down into the pouch 100, so that the bubbles attach to the area to be sealed of the pouch 100, which invites sealing failure. On the other hand, according to this modification example, the object to be packaged 200 can be guided into the pouch 100 along the sidewall part (for example, along the side edge 112*a*, 112*b*) of the inclined pouch 100. Thus, a falling distance of the object to be packaged 200 from the discharge outlet of the filling apparatus 34 up to the pouch 100 can be reduced, whereby the impact caused when the object to be packaged 200 falls down into the pouch 100 can be decreased. Thus, even when the object to be packaged 200 is an article that easily lathers, it is possible to prevent the object to be packaged 200 filled in the pouch 100 from lathering and causing sealing failure in the area that is intended to be sealed.

Obviously, the some modification examples of the above-described embodiment can be suitably combined with one another.

What is claimed is:

1. A bagging and packaging machine comprising:

a transport mechanism that transports a pouch in a standing posture, along a predetermined track, the pouch comprising an upper edge, a lower edge, and two side edges connecting the upper and lower edges, the upper and lower edges being parallel; and a plurality of processing units that process the pouch transported by the transport mechanism;

wherein the processing units include a filling unit that fills the pouch with an object to be packaged; and wherein the transport mechanism has a holding unit that holds the pouch, and a swinging mechanism that swings the pouch, which has been filled with the object to be packaged in the filling unit, in a vertical plane parallel to a transport direction, the vertical plane including all edges of the pouch, and wherein the swinging mechanism inclines the pouch so that the lower end edge of the pouch is displaced forward or rearward along the transport direction with respect to the upper end edge of the pouch.

2. The bagging and packaging machine according to claim 1, wherein the pouch is repeatedly moved and stopped along the predetermined track so as to be transported.

3. The bagging and packaging machine according to claim 2, wherein the swinging mechanism has:

a support unit that swingably supports the holding unit;

a drive source that swings the holding unit; and a control unit that controls an operation of the drive source.

4. The bagging and packaging machine according to claim 3, wherein the swinging mechanism further has:

a drive-source-side swinging member fixed with respect to a drive shaft of the drive source;

a holding-unit-side swinging member fixed with respect to the holding unit; and a coupling member that couples the drive-source-side swinging member and the holding-unit-side swinging member.

5. The bagging and packaging machine according to claim 4, wherein the control unit controls the operation of the drive source such that the upper end edge of the pouch and a surface of the object to be packaged in the pouch become parallel.

6. The bagging and packaging machine according to claim 3, wherein the control unit controls the operation of the drive source such that the upper end edge of the pouch and a surface of the object to be packaged in the pouch become parallel.

7. The bagging and packaging machine according to claim 3, further comprising a detection apparatus that detects a state of the object to be packaged in the pouch, wherein the control unit controls the operation of the drive source depending on the state of the object to be packaged detected by the detection apparatus.

8. The bagging and packaging machine according to claim 2, wherein the swinging mechanism has:

a support unit that swingably supports the holding unit; and a restriction unit that restricts the swinging movement of the holding unit within a predetermined range.

9. The bagging and packaging machine according to claim 2, wherein the holding unit has a pair of gripping units, and wherein one gripping unit of the pair of gripping units grips one side edge of the pouch, and the other gripping unit grips the other side edge of the pouch.

10. The bagging and packaging machine according to claim 1, wherein the swinging mechanism has:

a support unit that swingably supports the holding unit;

a drive source that swings the holding unit; and a control unit that controls an operation of the drive source.

11. The bagging and packaging machine according to claim 10, wherein the swinging mechanism further has:

a drive-source-side swinging member fixed with respect to a drive shaft of the drive source;

a holding-unit-side swinging member fixed with respect to the holding unit; and a coupling member that couples the drive-source-side swinging member and the holding-unit-side swinging member.

12. The bagging and packaging machine according to claim 11, wherein the control unit controls the operation of the drive source such that the upper end edge of the pouch and a surface of the object to be packaged in the pouch become parallel.

13. The bagging and packaging machine according to claim 10, wherein the control unit controls the operation of the drive source such that the upper end edge of the pouch and a surface of the object to be packaged in the pouch become parallel.

14. The bagging and packaging machine according to claim 10, further comprising a detection apparatus that detects a state of the object to be packaged in the pouch, wherein the control unit controls the operation of the drive source depending on the state of the object to be packaged detected by the detection apparatus.

15. The bagging and packaging machine according to claim 1, wherein the swinging mechanism has:

a support unit that swingably supports the holding unit; and a restriction unit that restricts the swinging movement of the holding unit within a predetermined range.

16. The bagging and packaging machine according to claim 1, wherein the holding unit has a pair of gripping units, and wherein one gripping unit of the pair of gripping units grips one side edge of the pouch, and the other gripping unit grips the other side edge of the pouch.

17. A bagging and packaging method having a plurality of processing steps that process a pouch that is transported in a standing posture, along a predetermined track, the pouch comprising an upper edge, a lower edge, and two side edges connecting the upper and lower edges, the upper and lower edges being parallel, wherein the processing steps include a filling step that fills the pouch with an object to be packaged, wherein the bagging and packaging method has a swinging step that swings the pouch in a vertical plane parallel to a transport direction, when the pouch is transported after the filling step, the vertical plane including all edges of the pouch, and wherein, in the swinging step, the pouch is inclined so that the lower end edge of the pouch is displaced forward or rearward along the transport direction with respect to the upper end edge of the pouch.

18. The bagging and packaging method according to claim 17, wherein the pouch is repeatedly moved and stopped along the predetermined track so as to be transported.

19. The bagging and packaging method according to claim 18, wherein in the swinging step, the pouch is swung such that the upper end edge of the pouch and a surface of the object to be packaged in the pouch become parallel.

20. The bagging and packaging method according to claim 17, wherein in the swinging step, the pouch is swung such that the upper end edge of the pouch and a surface of the object to be packaged in the pouch become parallel.

* * * * *